US007409347B1

(12) United States Patent
Bellegarda

(10) Patent No.: US 7,409,347 B1
(45) Date of Patent: Aug. 5, 2008

(54) DATA-DRIVEN GLOBAL BOUNDARY OPTIMIZATION

(75) Inventor: Jerome R. Bellegarda, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 912 days.

(21) Appl. No.: 10/692,994

(22) Filed: Oct. 23, 2003

(51) Int. Cl.

| | |
|---|---|
| ***G10L 13/00*** | (2006.01) |
| ***G10L 13/06*** | (2006.01) |
| *G10L 13/02* | (2006.01) |
| *G10L 13/04* | (2006.01) |

(52) U.S. Cl. ..... 704/267; 704/258; 704/265

(58) Field of Classification Search ..... 704/258, 704/260, 265, 267

See application file for complete search history.

(56) References Cited

U.S. PATENT DOCUMENTS

| | | | | |
|---|---|---|---|---|
| 3,828,132 | A | 8/1974 | Flanagan et al. | |
| 4,513,435 | A * | 4/1985 | Sakoe et al. | 704/255 |
| 5,490,234 | A * | 2/1996 | Narayan | 704/260 |
| 5,913,193 | A * | 6/1999 | Huang et al. | 704/258 |
| 6,208,967 | B1 * | 3/2001 | Pauws et al. | 704/256.8 |
| 6,266,637 | B1 * | 7/2001 | Donovan et al. | 704/258 |
| 6,304,846 | B1 * | 10/2001 | George et al. | 704/270 |
| 6,366,883 | B1 * | 4/2002 | Campbell et al. | 704/260 |
| 6,505,158 | B1 * | 1/2003 | Conkie | 704/260 |
| 6,665,641 | B1 * | 12/2003 | Coorman et al. | 704/260 |
| 6,697,780 | B1 * | 2/2004 | Beutnagel et al. | 704/258 |
| 6,980,955 | B2 * | 12/2005 | Okutani et al. | 704/258 |
| 7,058,569 | B2 * | 6/2006 | Coorman et al. | 704/216 |

OTHER PUBLICATIONS

Atal B., "Efficient Coding of LPC Parameters by Temporal Decomposition", Proc. ICASSP, 1983, pp. 81-84.*

Ahlbom et al, "Modeling Spectral Speech Transitions Using Temporal Decomposition Techniques," ICASSP, 1987, pp. 13-16.*

Donovan, "A New Distance Measure for Costing Spectral Discontinuities in Concatenative Speech Synthesisers," The 4th ISCA Tutorial and Research Workshop on Speech Synthesis, 2001.*

Vepa et al, "New Objective Distance Measures for Spectral Discontinuities in Concatenative Speech Synthesis," IEEE Workshop on Speech Synthesis 2002, NY, 2002, pp. 223-226.*

Klabbers, Esther, et al., "Reducing Audible Spectral Discontinuities," IEEE Transactions on Speech and Audio Processing, vol. 9 No. 1, Jan. 2001, pp. 39-51.

(Continued)

*Primary Examiner*—Patrick N. Edouard
*Assistant Examiner*—James S. Wozniak
(74) *Attorney, Agent, or Firm*—Blakely, Sokoloff, Taylor & Zafman LLP

(57) ABSTRACT

Portions from segment boundary regions of a plurality of speech segments are extracted. Each segment boundary region is based on a corresponding initial unit boundary. Feature vectors that represent the portions in a vector space are created. For each of a plurality of potential unit boundaries within each segment boundary region, an average discontinuity based on distances between the feature vectors is determined. For each segment, the potential unit boundary associated with a minimum average discontinuity is selected as a new unit boundary.

24 Claims, 6 Drawing Sheets

OTHER PUBLICATIONS

Bellegarda, Jerome R., "Exploiting Latent Semantic Information in Statistical Language Modeling," Proceedings of the IEEE, Aug. 2000, pp. 1-18.

Wu, Min, "Digital Speech Processing and Coding," Electrical & Computer Engineering, University of Maryland, College Park, Feb. 4, 2003, pp. 1-11.

Bellegarda, Jerome R., "Global Boundary-Centric Feature Extraction And Associated Discontinuity Metrics," United State Patent Application, filed Oct. 23, 2003.

Bellegarda, Jerome R. "Global Boundary-Centric Feature Extraction And Associated Discontinuity Metrics", United States Patent Application and Figures, U.S. Appl. No. 10/693,227, filed Oct. 23, 2003, 67 pages.

* cited by examiner

DATA-DRIVEN GLOBAL BOUNDARY OPTIMIZATION

COPYRIGHT NOTICE/PERMISSION

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever. The following notice applies to the software and data as described below and in the drawings hereto: Copyright©2003, Apple Computer, Inc., All Rights Reserved.

TECHNICAL FIELD

This disclosure relates generally to text-to-speech synthesis, and in particular relates to concatenative speech synthesis.

BACKGROUND OF THE INVENTION

In concatenative text-to-speech synthesis, the speech waveform corresponding to a given sequence of phonemes is generated by concatenating pre-recorded segments of speech. These segments are extracted from carefully selected sentences uttered by a professional speaker, and stored in a database known as a voice table. Each such segment is typically referred to as a unit. A unit may be a phoneme, a diphone (the span between the middle of a phoneme and the middle of another), or a sequence thereof. A phoneme is a phonetic unit in a language that corresponds to a set of similar speech realizations (like the velar \k\ of cool and the palatal \k\ of keel) perceived to be a single distinctive sound in the language.

The quality of the synthetic speech resulting form concatenative text-to-speech (TTS) synthesis is heavily dependent on the underlying inventory of units. A great deal of attention is typically paid to issues such as coverage (i.e. whether all possible units represented in the voice table), consistency (i.e. whether the speaker is adhering to the same style throughout the recording process), and recording quality (i.e. whether the signal-to-noise is as high as possible at all times). However, an important aspect of the unit inventory relates to unit boundaries, i.e. how the segments are cut after recording. This aspect is important because the defined boundaries influence the degree of discontinuity after concatenation, and therefore how natural the synthetic speech will sound. Early TTS systems based on phoneme units had difficulty ensuring a good transition between two phonemes due to coarticulation effects. Systems based on diphone units, or sequences thereof, are generally better since there is typically less coarticulation at the ensuing concatenation points. Nevertheless, the finite size of the unit inventory implies that discontinuities are inevitable. As a result, minimizing their number and salience is important in concatenative TTS.

In diphone synthesis, the number of diphone units is small enough (e.g. about 2000 in English) to enable manual boundary optimization. In that case, the unit boundaries are adjusted manually so as to achieve, on the average, as good a concatenation as possible given any possible pair of compatible diphones. This tends to eliminate the most egregious discontinuities, but typically introduces many compromises which may degrade naturalness. In contrast, polyphone synthesis allows multiple instances of every unit, usually recorded under complementary, carefully controlled conditions. Due to the much larger size of the unit inventory, adjusting unit boundaries manually is no longer feasible.

SUMMARY OF THE DESCRIPTION

Methods and apparatuses for data-driven global boundary optimization are described herein. The following provides as summary of some, but not all, embodiments described within this disclosure; it will be appreciated that certain embodiments which are claimed will not be summarized here. In one exemplary embodiment, automatic off-line training of boundaries for speech segments used in a concatenation process is provided. The training produces an optimized inventory of units given the training data at hand. All unit boundaries in the training data are globally optimized such that, on the average, the perceived discontinuity at the concatenation between every possible pair of segments is minimal. This provides uniformly high quality units to choose from at run time.

The present invention is described in conjunction with systems, clients, servers, methods, and machine-readable media of varying scope. In addition to the aspects of the present invention described in this summary, further aspects of the invention will become apparent by reference to the drawings and by reading the detailed description that follows.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

In the following detailed description of embodiments of the invention, reference is made to the accompanying drawings in which like reference indicate similar elements, and in which is shown by way of illustration specific embodiments in which the invention may be practiced. These embodiments are described in sufficient detail to enable those skilled in the art to practice the invention, and it is to be understood that other embodiments may be utilized and that logical, mechanical, electrical, functional, and other changes may be made without departing from the scope of the present invention. The following detailed description is, therefore, not to be taken in a limiting sense, and the scope of the present invention is defined only by the appended claims.

Figure 1:
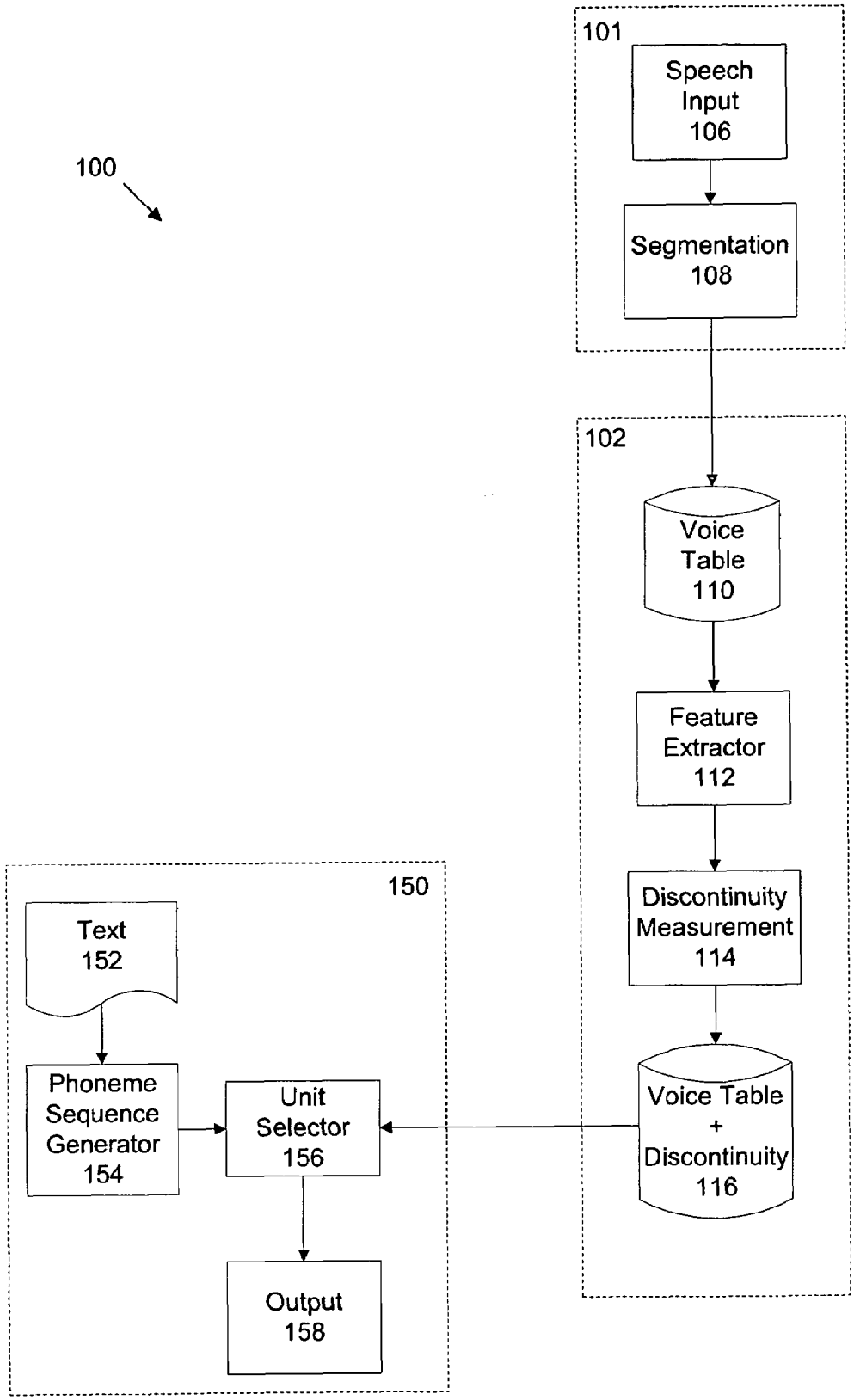
FIG. 1 illustrates a system level overview of an embodiment of a text-to-speech (TTS) system.

FIG. 1 illustrates a system level overview of an embodiment of a text-to-speech (TTS) system 100 which produces a speech waveform 158 from text 152. TTS system 100 includes three components: a segmentation component 101, a voice table component 102 and a run-time component 150.

Segmentation component 101 divides recorded speech input 106 into segments for storage in a voice table 110. Voice table component 102 handles the formation of a voice table 116 with discontinuity information. Run-time component 150 handles the unit selection process during text-to-speech synthesis.

Recorded speech from a professional speaker is input at block 106. In one embodiment, the speech may be a user's own recorded voice, which may be merged with an existing database (after suitable processing) to achieve a desired level of coverage. The recorded speech is segmented into units at segmentation block 108. Segmentation is described in greater detail below.

Contiguity information is preserved in the voice table 110 so that longer speech segments may be recovered. For example, where a speech segment $S_1$-$R_1$ is divided into two segments. $S_1$ and $R_1$, information is preserved indicating that the segments are contiguous; i.e. there is no artificial concatenation between the segments.

In one embodiment, a voice table 110 is generated from the segments produced by segmentation block 108. In another embodiment, voice table 110 is a pre-generated voice table that is provided to the system 100. Feature extractor 112 mines voice table 110 and extracts features from segments so that they may be characterized and compared to one another.

Once appropriate features have been extracted from the segments stored in voice table 110, discontinuity measurement block 114 computes a discontinuity between segments. In one embodiment, discontinuities are determined on a phoneme by phoneme basis; i.e. only discontinuities between segments having a boundary within the same phoneme are computed. Discontinuity measurements for each segment are added as values to the voice table 110 to form a voice table 116 with discontinuity information. Further details may be found in co-filed U.S. patent application Ser. No. 10/693,227, entitled "Global Boundary-Centric Feature Extraction and Associated Discontinuity Metrics," filed Oct. 23, 2003, assigned to Apple Computer, Inc., the assignee of the present invention, and which is herein incorporated by reference.

Run-time component 150 handles the unit selection process. Text 152 is processed by the phoneme sequence generator 154 to convert text to phoneme sequences. Text 152 may originate from any of several sources, such as a text document, a web page, an input device such as a keyboard, or through an optical character recognition (OCR) device. Phoneme sequence generator 154 converts the text 152 into a string of phonemes. It will be appreciated that in other embodiments, phoneme sequence generator 154 may produce strings based on other suitable divisions, such as diphones.

Unit selector 156 selects speech segments from the voice table 116 to represent the phoneme string. In one embodiment, the unit selector 156 selects segments based on discontinuity information stored in voice table 116. Once appropriate segments have been selected, the segments are concatenated to form a speech waveform for playback by output block 158. In one embodiment, segmentation component 101 and voice table component 102 are implemented on a server computer, and the run-time component 150 is implemented on a client computer.

It will be appreciated that although embodiments of the present invention are described primarily with respect to phonemes, other suitable divisions of speech may be used. For example, in one embodiment, instead of using divisions of speech based on phonemes (linguistic units), divisions based on phones (acoustic units) may be used.

Embodiments of the processing represented by segmentation block 108 are now described. As discussed above, segmentation refers to creating a unit inventory by defining unit boundaries; i.e. cutting recorded speech into segments. Unit boundaries and the methodology used to define them influence the degree of discontinuity after concatenation, and therefore, the degree to which synthetic speech sounds natural. In one embodiment, unit boundaries are optimized before applying the unit selection procedure so as to preserve contiguous segments while minimizing poor potential concatenations. The optimization of the present invention provides uniformly high quality units to choose from at run-time for unit selection. Off-line optimization is referred to as automatic "training" of the unit inventory, in contrast to the run-time "decoding" process embedded in unit selection.

In one embodiment, a discontinuity metric, described below, is derived from a global feature extraction method which characterizes the entire boundary region of a particular unit. Since this discontinuity metric is capable of taking into account all potentially relevant speech segments, it is possible to globally train individual unit boundaries in a data-driven manner. Thus, segmentation may be performed automatically without the need for human supervision.

Figure 2:
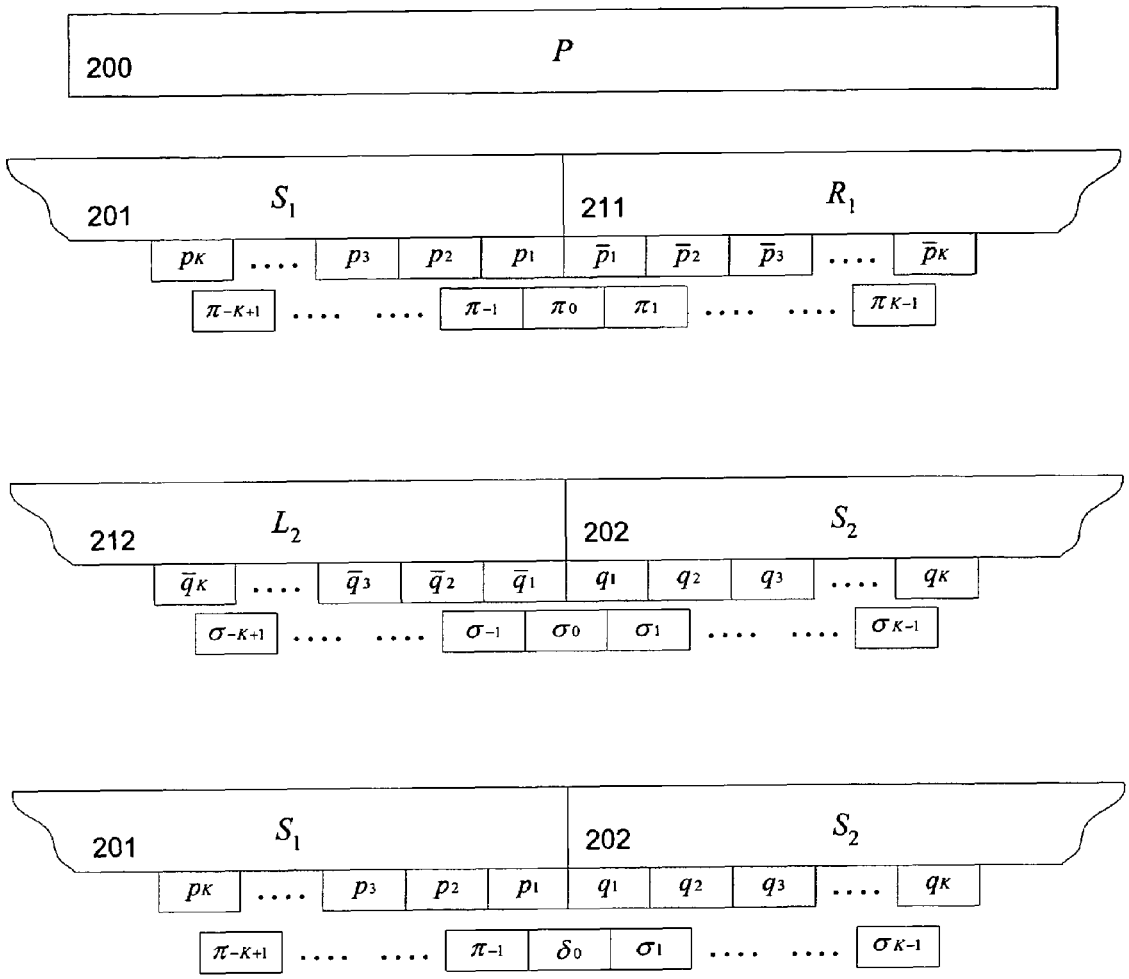
FIG. 2 illustrates an example of speech segments having a boundary in the middle of a phoneme.

For the purpose of clarity, optimizing the associated boundaries for all relevant unit instances is described in terms of a set including all unit instances with a boundary in the middle of a phoneme P. FIG. 2 illustrates an example of speech segments ending and starting in the middle of the phoneme P 200. $S_1$-$R_1$ and $L_2$-$S_2$ are two such segments. A concatenation in the middle of the phoneme P 200 is considered. Assume that the voice table contains the contiguous segments $S_1$-$R_1$ and $L_2$-$S_2$, but not $S_1$-$S_2$. A speech segment $S_1$ 201 ends with the left half of P 200, and a speech segment $S_2$ 202 starts with the right half of P 200. Further denote by $R_1$ 211 and $L_2$ 212 the segments contiguous to $S_1$ 201 on the right and to $S_2$ 202 on the left, respectively (i.e., $R_1$ 211 comprises the second half of the P 200 in $S_1$ 201, and $L_2$ 212 comprises the first half of the P 200 in $S_2$ 202).

The segments may be divided into portions. For example, in one embodiment, the portions are based on pitch periods. A pitch period is the period of vocal cord vibration that occurs during the production of voiced speech. In one embodiment, for voiced speech segments, each pitch period is obtained through conventional pitch epoch detection, and for voiceless segments, the time-domain signal is similarly chopped into analogous, albeit constant-length, portions.

Referring again to FIG. 2, let $p_K \ldots p1$ denote the last K pitch periods of $S_1$ 201, and $\bar{p}1 \ldots \bar{p}_K$ denote the first K pitch periods of $R_1$ 211, so that the boundary between $S_1$ 201 and $R_1$ 211 falls in the middle of the span $p_K \ldots p1\ \bar{p}1 \ldots \bar{p}_K$. Similarly, let $q1 \ldots q_K$ be the first K pitch periods of $S_2$ 202, and $\bar{q}_K \ldots \bar{q}1$ be the last K pitch periods of $L_2$ 212, so that the boundary between $L_2$ 212 and $S_2$ 202 fails in the middle of the span $\bar{q}_K \ldots \bar{q}1\ q1 \ldots q_K$. As a result, the boundary region between $S_1$ and $S_2$ can be represented by $p_K \ldots p1\ q1 \ldots q_K$.

In one embodiment, centered pitch periods are considered. Centered pitch periods include the right half of a first pitch period, and the left half of an adjacent second pitch period. Referring to FIG. 2, to derive centered pitch periods, the samples are shuffled to consider instead the span $\pi_{-K+1} \ldots \pi 0 \ldots \pi_{K-1}$, where the centered pitch periods $\pi 0$ comprises the right half of p1 and the left half of $\bar{p}1$, a centered pitch period $\pi_{-k}$ comprises the right half of pk+1 and the left half of pk, and a centered pitch period $\pi k$ comprised the right half of $\bar{p}k$ and the left half of $\bar{p}k+1$, for $1 \leqq k \leqq K-1$. This results in 2K−1 centered pitch periods instead of 2K pitch periods, with the boundary between $S_1$ 201 and $R_1$ 211 falling exactly in the middle of $\pi 0$. Similarly, the boundary between $L_2$ 212 and $S_2$ 202 falls in the middle of the span $\bar{q}\kappa \ldots \bar{q}1\ q1 \ldots q\kappa$, corresponding to the span of centered pitch periods $\sigma-\kappa+1 \ldots \sigma 0 \ldots \sigma\kappa-1$.

An advantage of the centered representation of centered pitch periods is that the boundary may be precisely characterized by one vector in a global vector space, instead of inferred a posteriori from the position of the two vectors on either side. In other words, unit boundary optimization focuses on minimizing the convex hull of all vectors associated with all possible $\pi 0$. It will be appreciated that in other embodiments, divisions of the segments other than pitch periods or centered pitch periods may be employed.

If the set of all units were limited to the two instances illustrated in FIG. 2, $S_1$-$R_1$ and $L_2$-$S_2$, a boundary optimization process of the present invention jointly adjusts the boundary between $S_1$ and $R_1$ and the boundary between $L_2$ and $S_2$ so that all of the resulting $S_1$-$S_2$, $S_1$-$R_1$, $L_2$-$S_2$, $L_2$-$S_2$, and $L_2$-$S_2$ concatenation exhibit minimal discontinuities. In the more general case, there are M segments like $S_1$-$R_1$ and $L_2$-$S_2$, i.e. with a boundary in the middle of the phoneme P. The boundary optimization process jointly optimizes the M associated boundaries such that all $M^2$ possible concatenation exhibit minimal discontinuities. In one embodiment, as described below, a discontinuity is generally expressed in terms of how far apart vectors are in a global vector space representing the boundary region associated with the relevant instances.

Figure 3:
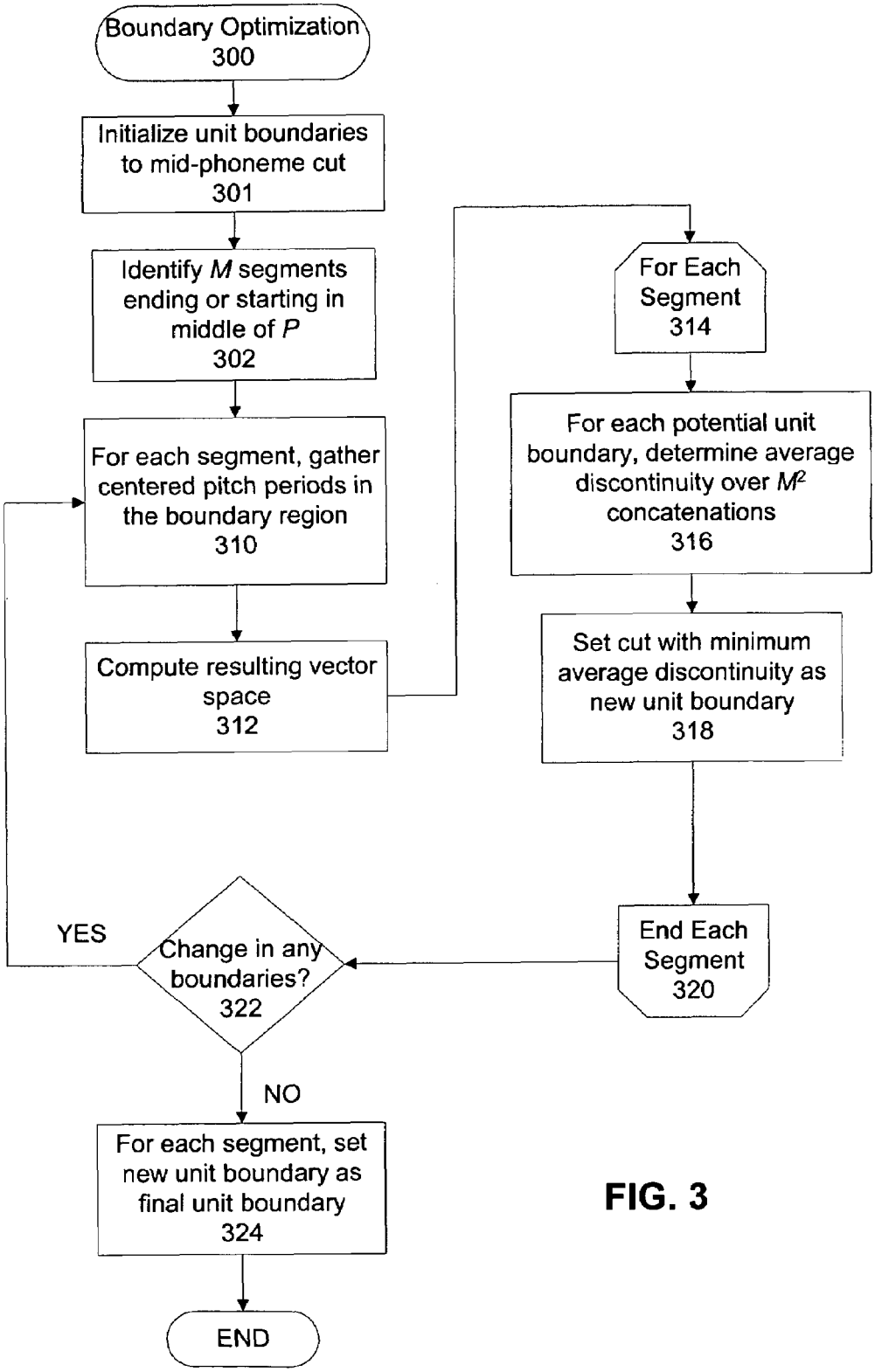
FIG. 3 illustrates a flow chart of an embodiment of a boundary optimization method.

FIG. 3 illustrates a flow chart of an embodiment of the processing for a boundary optimization method 300. At block 301, the method 300 initializes unit boundaries at the midpoint of a phoneme, P. The midpoint of the phoneme P for each segment may be identified by an automatic phoneme aligner using conventional speech recognition technology. The phoneme aligner does not need to be extremely accurate because it only needs to provide a reasonable estimate of the phoneme boundaries to be able to yield a plausible mid-phoneme cut. In one embodiment, the processing represented by block 301 is performed on recorded speech input at block 106 of FIG. 1, to provide initial unit boundaries. In another embodiment, the boundary optimization method 300 is used to optimize pre-defined unit boundaries within a voice table of segments. In still yet another embodiment, unit boundaries may be initialized at another point within the speech segments. For example, unit boundaries may be initialized where the speech waveform varies the least.

At block 302, the method 300 identifies M segments with an initial unit boundary in the middle of the phoneme P. At block 310, the method 300 gathers centered pitch periods within boundary regions of the M segments. A boundary region includes K pitch periods on either side of a designated boundary. For each segment, centered pitch periods are derived from the pitch periods surrounding the initial unit boundary as described above. In one embodiment, K−1 centered pitch periods for each of the M segments are gathered into a matrix W. The maximum number of time samples, N, observed among the extracted centered pitch periods, is identified. The extracted centered pitch periods are padded with zeros, such that each centered pitch period has N samples. In one embodiment, the centered pitch periods are zero padded symmetrically, meaning that zeros are added to the left and right side of the samples. In one embodiment, K=3. In one embodiment, M and N are on the order of a few hundreds.

Figure 4:
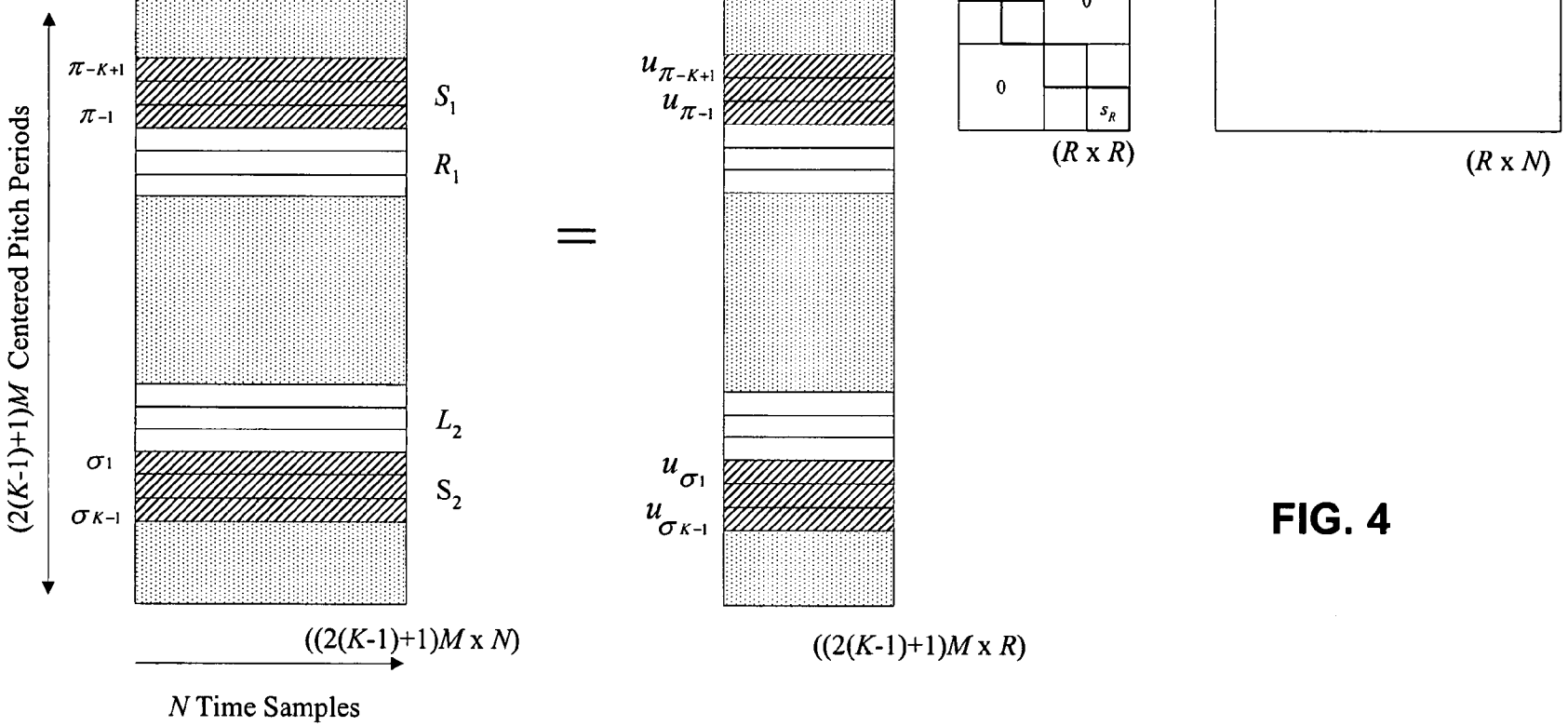
FIG. 4 illustrates an embodiment of the decomposition of an input matrix.

In one embodiment, matrix W is a $(2(K-1)+1)M \times N$ matrix, W, as illustrated in FIG. 4 and described in greater detail below. Matrix W has $(2(K-1)+1)M$ rows, each row corresponding to a particular centered pitch period surrounding the initial unit boundary. Matrix W has N columns, each column corresponding to time samples within each centered pitch period.

At block 312, the method 300 computes the resulting vector space by performing a Singular Value Decomposition (SVD) of the matrix, W, to derive feature vectors. In one embodiment, the feature vectors are derived by performing a matrix-style modal analysis through a singular value decomposition (SVD) of the matrix W, as:

$$W = U\Sigma V^T \tag{1}$$

where U is the $(2(K-1)+1)M \times R$ left singular matrix with row vectors $u_i (1 \leqq i \leqq (2(K-1)+1)M)$, $\Sigma$ is the $R \times R$ diagonal matrix of singular values $s_1 \geqq s_2 \geqq \ldots \geqq s_R > 0$, V is the $N \times R$ right singular matrix with row vectors $v_j (1 \leqq j \leqq N)$, $R << (2(K-1)+1)M$), and $^T$ denotes matrix transposition. The vector space of dimension R spanned by the $u_i$'s and $v_j$'s is referred to as the SVD space. In one embodiment, R=5.

FIG. 4 illustrates an embodiment of the decomposition of the matrix W 400 into U 401, $\Sigma$ 403 and $V^T$ 405. This (rank-R) decomposition defines a mapping between the set of centered pitch periods, and, after appropriate scaling by the singular values of $\Sigma$, the set of R-dimensional vectors $\bar{u}_i = u_i\Sigma$. The latter are the feature vectors resulting from the extraction mechanism.

Since time-domain samples are used, both amplitude and phase information are retained, and in fact contribute simultaneously to the outcome. This mechanism takes a global view of what is happening in the boundary region, as reflected in the SVD vector space spanned by the resulting set of left and right singular vectors. In fact, each row of the matrix (i.e. centered pitch period) is associated with a vector in that space. These vectors can be viewed as feature vectors, and thus directly lead to new metrics $d(S_1, S_2)$ defined on the SVD vector space. The relative positions of the feature vectors are determined by the overall pattern of the time-domain samples observed in the relevant centered pitch periods, as opposed to a (frequency domain or otherwise) processing specific to a particular instance. Hence, two vectors $\bar{u}_k$ and $\bar{u}_l$, which are "close" (in a suitable metric) to one another can be expected to reflect a high degree of time-domain similarity, and thus potentially a small amount of perceived discontinuity.

The SVD results in $(2(K-1)+1)M$ feature vectors in the global vector space. In one embodiment, unit boundaries are not permitted at either extreme of the boundary region; therefore, there are $(2(K-2)+1)M$ potential unit boundaries within the global vector space. Each potential unit boundary defines two candidate units for each speech segment.

Once appropriate feature vectors are extracted from matrix W, a distance or metric is determined between vectors as a measure of perceived discontinuity between segments. In one embodiment, a suitable metric exhibits a high correlation between $d(S_1,S_2)$ and perception. In one embodiment, a value $d(S_1,S_2)=0$ should highly correlate with zero discontinuity, and a large value of $d(S_1,S_2)$ should highly correlate with a large perceived discontinuity.

In one embodiment, the cosine of the angle between two vectors is determined to compare $\bar{u}_k$ and $\bar{u}_l$ in the SVD space. This results in the closeness measure:

$$C(\bar{u}_k, \bar{u}_l) = \cos(u_k\Sigma, u_l\Sigma) = \frac{u_k \sum^{2} u_l^T}{\|u_k\Sigma\|\ \|u_l\Sigma\|} \tag{2}$$

for any $1 \leqq k, 1 \leqq (2(K-1)+1)M$. This measure in turn leads to a variety of distance metrics in the SVD space.

When considering centered pitch periods, the discontinuity for a concatenation may be computed in terms of trajectory difference rather than location difference. To illustrate, consider the two sets of centered pitch periods $\pi_{-K+1} \ldots \pi_0 \ldots \pi_{K-1}$ and $\sigma_{-K+1} \ldots \sigma_0 \ldots \sigma_{K-1}$, defined as above for the two segments $S_1$-$R_1$ and $L_2$-$S_2$. After performing the SVD as described above, the result is a global vector space comprising the vectors $u_{\pi k}$ and $u_{\sigma k}$, representing the centered pitch periods $\pi_k$ and $\sigma_k$, respectively, for $(-K+1 \leqq k \leqq K-1)$. Consider the potential concatenation $S_1$-$S_2$ of these two segments, obtained as $\pi_{-K+1} \ldots \pi_{-1}\ \delta_0\ \sigma_1 \ldots \sigma_{K-1}$, where $\delta_0$ represents the concatenated centered pitch period (i.e., consisting of the left half of $\pi_0$ and the right half of $\sigma_0$). This sequence has a corresponding representation in the global vector space given by:

$$u_{\pi-K+1} \ldots u_{\pi-1}\, u\delta_0\, u_{\sigma 1} \ldots u_{94\ K-1} \tag{3}$$

In one embodiment, the discontinuity associated with this concatenation is expressed as the cumulative difference in closeness before and after the concatenation:

$$d(S_1,S_2)=C(u_{\pi-1}, u\delta_0)+C(u\delta_0, u_{\sigma 1})-C(u_{\pi-1}, u_{\pi 0})-C(u_{\sigma 0}, u_{\sigma 1}) \tag{4}$$

where the closeness function C assumes the same functional form as in (2). This metric exhibits the property $d(S_1,S_2) \geqq 0$, where $d(S_1,S_2)=0$ if and only if $S_1=S_2$. In other words, the metric is guaranteed to be zero anywhere there is no artificial concatenation, and strictly positive at an artificial concatenation point. This ensures that contiguously spoken pitch periods always resemble each other more than the two pitch periods spanning a concatenation point.

Referring again to FIG. 3, the processing represented by blocks 314 through 320 is performed for each segment. For each potential unit boundary, there are $M^2$ possible concatenations of candidate units. At block 316, the method 300 computes the average discontinuity associated with each potential unit boundary by accumulating the discontinuity for each of the $M^2$ possible concatenations associated with the particular potential unit boundary. In one embodiment, this results in $(2(K-2)+1)M^2$ discontinuity measures for each segment. At block 318, the method 300 sets the potential unit boundary associated with the minimum average discontinuity as the new unit boundary for the observation. In one embodiment, the method 300 weighs the average discontinuity in such a way that, all other things being equal, a cut point near the middle of the phoneme is more probable than a cut point near the edges of the phoneme. This is to minimize the method 300 from placing the cut point too close to the edges of the phoneme, and thereby define two segments whose lengths differ by, for example, more than an order of magnitude.

The method 300 determines at block 322 whether there has been any change in unit boundaries for any of the segments. For each segment, the new unit boundary is compared to the corresponding initial unit boundary. If there was at least one change in any of the boundaries for the segments, the processing returns to block 310. The procedure iterates the processing represented by blocks 310 to 322 until all of the new unit boundaries are the same as the corresponding initial unit boundaries. In one embodiment, the iterative process converges after about ten to fifteen iterations. If the method 300 determines at block 322 that there has been no change in any of the boundaries since the previous cut, the new unit boundaries for each segment are set as final unit boundaries at block 324. The final unit boundaries define individual units which collectively make up the unit inventory. The unit inventory is subsequently added to a final voice table, such as voice table 110 of FIG. 1.

The final unit boundaries are therefore globally optimal across the entire set of observations for the phoneme P. This provides an inventory of units whose boundaries are collectively globally optimal given the same discontinuity measure later used in actual unit selection. The result is a better usage of the available training data, as well as tightly matched conditions between training and decoding.

In one embodiment, the boundary optimization method 300 is performed for each phoneme. In one embodiment, each instance in the voice table has more than one final unit boundary associated with it. For example, an instance may have a first unit boundary for concatenation with a first set of units, and a second unit boundary for concatenation with a second set of units.

Proof of concept testing has been performed on an embodiment of the boundary optimization method. Preliminary experiments were conducted on data recorded to build the voice table used in MacinTalk™ for MacOS® X version 10.3, available from Apple Computer, Inc., the assignees of the present invention. The focus of these experiments was the phoneme P=OY. All instances of speech segments (in this case, diphones) with a left or right boundary falling in the middle of the phoneme OY. For each instance, K=3 pitch periods on the left of the boundary and K=3 pitch periods on the right of the boundary were extracted, leading to 2K−1=5 centered pitch periods for each instance. The boundary optimization method was then performed as described above with respect to FIG. 3 to derive the globally optimum "cut" in each instance. As a baseline, the initial boundaries used were determined based on where the speech waveform varies the least. The boundaries produced by the boundary optimization method were uniformly observed to be improved over the baseline boundaries. The improvement resulted in part because the boundaries were not constrained to lie in the (local) steady state region of the unit, which is not optimal for a diphone, such as OY. Instead, the boundaries were able to be moved in an unsupervised manner to achieve the relevant global minimum.

Figure 5A:
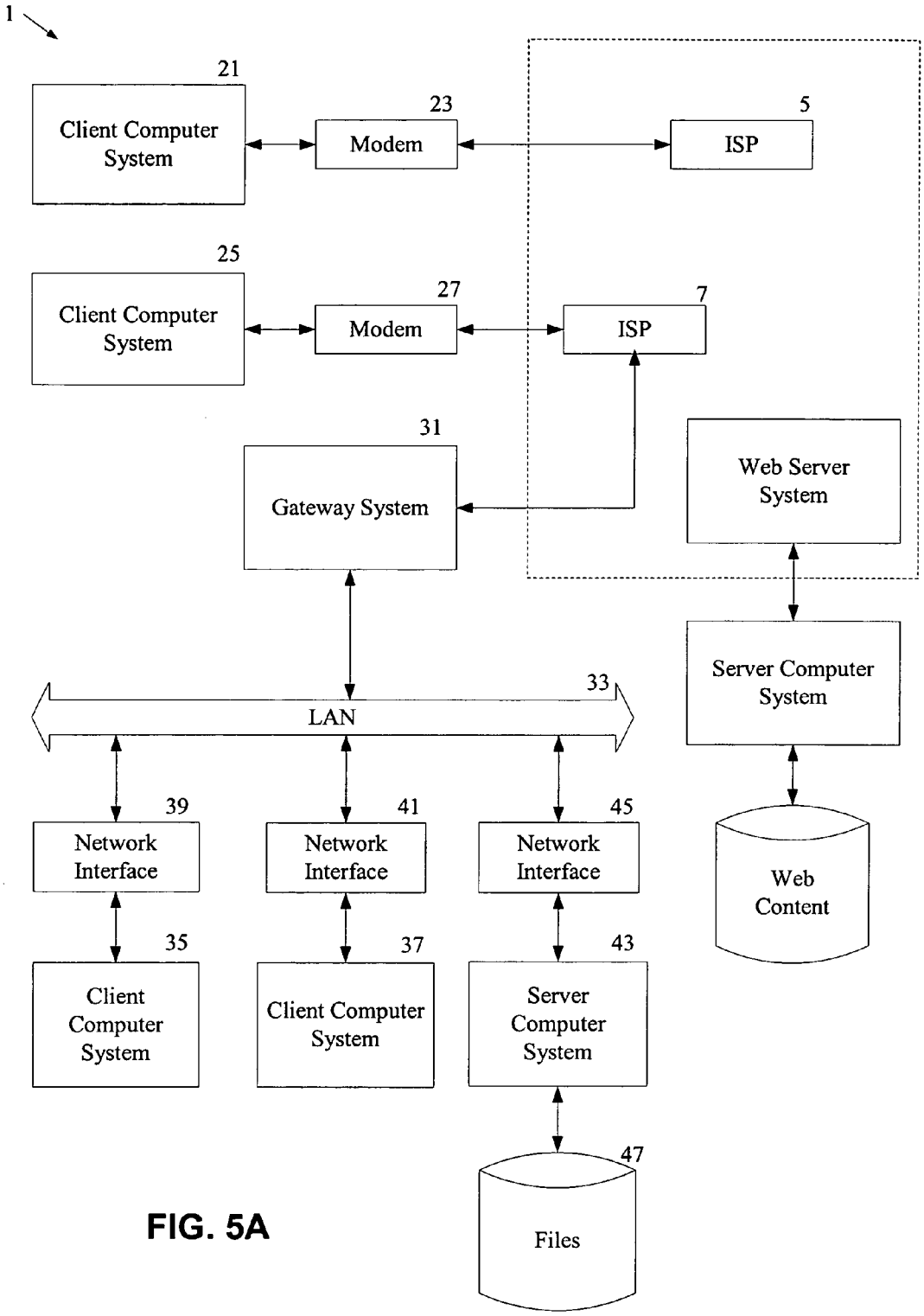
FIG. 5A is a diagram of one embodiment of an operating environment suitable for practicing the present invention.
Figure 5B:
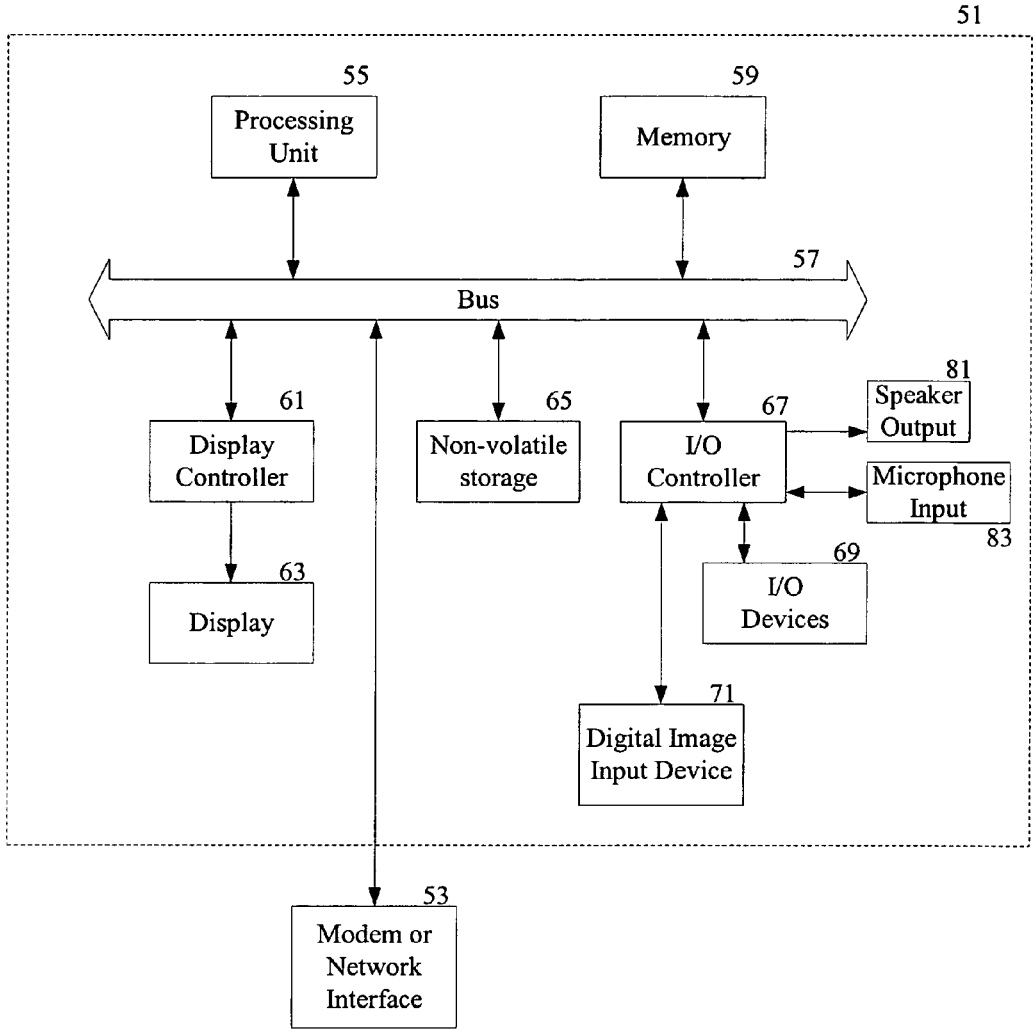
FIG. 5B is a diagram of one embodiment of a computer system suitable for use in the operating environment of FIG. 5A.

The following description of FIGS. 5A and 5B is intended to provide an overview of computer hardware and other operating components suitable for performing the methods of the invention described above, but is not intended to limit the applicable environments. One of skill in the art will immediately appreciate that the invention can be practiced with other computer system configurations, including hand-held devices, multiprocessor systems, microprocessor-based or programmable consumer electronics/appliances, network PCs, minicomputers, mainframe computers, and the like. The invention can also be practiced in distributed computing environments where tasks are performed by remote processing devices that are linked through a communications network.

FIG. 5A shows several computer systems 1 that are coupled together through a network 3, such as the Internet. The term "Internet" as used herein refers to a network of networks which uses certain protocols, such as the TCP/IP protocol, and possibly other protocols such as the hypertext transfer protocol (HTTP) for hypertext markup language (HTML) documents that make up the World Wide Web (web). The physical connections of the Internet and the protocols and communication procedures of the Internet are well known to those of skill in the art. Access to the Internet 3 is typically provided by Internet service providers (ISP), such as the ISPs 5 and 7. Users on client systems, such as client computer systems 21, 25, 35, and 37 obtain access to the Internet through the Internet service providers, such as ISPs 5 and 7. Access to the Internet allows users of the client computer systems to exchange information, receive and send e-mails, and view documents, such as documents which have been prepared in the HTML format. These documents are often provided by web servers, such as web server 9 which is considered to be "on" the Internet. Often these web servers are provided by the ISPs, such as ISP 5, although a computer system can be setup and connected to the Internet without that system being also an ISP as is well known in the art.

The web server 9 is typically at least one computer system which operates as a server computer system and is configured to operate with the protocols of the World Wide Web and is coupled to the Internet. Optionally, the web server 9 can be part of an ISP which provides access to the Internet for client systems. The web server 9 is shown coupled to the server computer system 11 which itself is coupled to web content 10, which can be considered a form of a media database. It will be appreciated that while two computer systems 9 and 11 are shown in FIG. 5A, the web server system 9 and the server computer system 11 can be one computer system having different software components providing the web server functionality and the server functionality provided by the server computer system 11 which will be described further below.

Client computer systems 21, 25, 35, and 37 can each, with the appropriate web browsing software, view HTML pages provided by the web server 9. The ISP 5 provides Internet connectivity to the client computer system 21 through the modem interface 23 which can be considered part of the client computer system 21. The client computer system can be a personal computer system, consumer electronics/appliance, a network computer, a Web TV system, a handheld device, or other such computer system. Similarly, the ISP 7 provides Internet connectivity for client systems 25, 35, and 37, although as shown in FIG. 5A, the connections are not the same for these three computer systems. Client computer system 25 is coupled through a modem interface 27 while client computer systems 35 and 37 are part of a LAN. While FIG. 5A shows the interfaces 23 and 27 as generically as a "modem," it will be appreciated that each of these interfaces can be an analog modem, ISDN modem, cable modem, satellite transmission interface, or other interfaces for coupling a computer system to other computer systems. Client computer systems 35 and 37 are coupled to a LAN 33 through network interfaces 39 and 41, which can be Ethernet network or other network interfaces. The LAN 33 is also coupled to a gateway computer system 31 which can provide firewall and other Internet related services for the local area network. This gateway computer system 31 is coupled to the ISP 7 to provide Internet connectivity to the client computer systems 35 and 37. The gateway computer system 31 can be a conventional server computer system. Also, the web server system 9 can be a conventional server computer system.

Alternatively, as well-known, a server computer system 43 can be directly coupled to the LAN 33 through a network interface 45 to provide files 47 and other services to the clients 35, 37, without the need to connect to the Internet through the gateway system 31.

FIG. 5B shows one example of a conventional computer system that can be used as a client computer system or a server computer system or as a web server system. It will also be appreciated that such a computer system can be used to perform many of the functions of an Internet service provider, such as ISP 5. The computer system 51 interfaces to external systems through the modem or network interface 53. It will be appreciated that the modem or network interface 53 can be considered to be part of the computer system 51. This interface 53 can be an analog modem, ISDN modem, cable modem, token ring interface, satellite transmission interface, or other interfaces for coupling a computer system to other computer systems. The computer system 51 includes a processing unit 55, which can be a conventional microprocessor such as an Intel Pentium microprocessor or Motorola Power PC microprocessor. Memory 59 is coupled to the processor 55 by a bus 57. Memory 59 can be dynamic random access memory (DRAM) and can also include static RAM (SRAM). The bus 57 couples the processor 55 to the memory 59 and also to non-volatile storage 65 and to display controller 61 and to the input/output (I/O) controller 67. The display controller 61 controls in the conventional manner a display on a display device 63 which can be a cathode ray tube (CRT) or liquid crystal display (LCD). The input/output devices 69 can include a keyboard, disk drives, printers, a scanner, and other input and output devices, including a mouse or other pointing device. The display controller 61 and the I/O controller 67 can be implemented with conventional well known technology. A speaker output 81 (for driving a speaker) is coupled to the I/O controller 67, and a microphone input 83 (for recording audio inputs, such as the speech input 106) is also coupled to the I/O controller 67. A digital image input device 71 can be a digital camera which is coupled to an I/O controller 67 in order to allow images from the digital camera to be input into the computer system 51. The non-volatile storage 65 is often a magnetic hard disk, an optical disk, or another form of storage for large amounts of data. Some of this data is often written, by a direct memory access process, into memory 59 during execution of software in the computer system 51. One of skill in the art will immediately recognize that the terms "computer-readable medium" and "machine-readable medium" include any type of storage device that is accessible by the processor 55 and also encompass a carrier wave that encodes a data signal.

It will be appreciated that the computer system 51 is one example of many possible computer systems which have different architectures. For example, personal computers based on an Intel microprocessor often have multiple buses, one of which can be an input/output (I/O) bus for the peripherals and one that directly connects the processor 55 and the memory 59 (often referred to as a memory bus). The buses are connected together through bridge components that perform any necessary translation due to differing bus protocols.

Network computers are another type of computer system that can be used with the present invention. Network computers do not usually include a hard disk or other mass storage, and the executable programs are loaded from a network connection into the memory 59 for execution by the processor 55. A Web TV system, which is known in the art, is also considered to be a computer system according to the present invention, but it may lack some of the features shown in FIG. 5B, such as certain input or output devices. A typical computer system will usually include at least a processor, memory, and a bus coupling the memory to the processor.

It will also be appreciated that the computer system 51 is controlled by operating system software which includes a file management system, such as a disk operating system, which is part of the operating system software. One example of an operating system software with its associated file management system software is the family of operating systems known as MAC® OS from Apple Computer, Inc. of Cupertino, Calif., and their associated file management systems. The file management system is typically stored in the non-volatile storage 65 and causes the processor 55 to execute the various acts required by the operating system to input and output data and to store data in memory, including storing files on the non-volatile storage 65.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize. These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A machine-implemented method comprising:

extracting portions from segment boundary region of a plurality of speech segments, each segment boundary region based on a corresponding initial unit boundary;

creating feature vectors that represent the portions in a vector space;

for each of a plurality of potential unit boundaries within each segment boundary region, determining an average discontinuity based on distances between the feature vectors; and for each segment, selecting the potential unit boundary associated with a minimum average discontinuity as a new unit boundary;

wherein the portions include centered pitch periods, the centered pitch periods derived from pitch periods of the segments, wherein the feature vectors incorporate phase information of the portions, wherein creating feature vectors comprises:

constructing a matrix W from the portions; and decomposing the matrix W, and wherein the matrix W is a $(2(K-1)+1)M\times N$ matrix represented by $W=U\Sigma V^T$ where K−1 is the number of centered pitch periods near the potential unit boundary extracted from each segment, N is the maximum number of samples among the centered pitch periods, M is the number of segments, U is the $(2(K-1)+1)M\times R$ left singular matrix with row vectors $u_i(1\leqq i\leqq(2(K-1)+1)M)$, Σ is the R×R diagonal matrix of singular values $s_1\geqq s_2\geqq \ldots \geqq s_R>0$, V is the N×R right singular matrix with row vectors $v_j(1\leqq j\leqq N)$, $R<<(2(K-1)+1)M)$, and $^T$ denotes matrix transposition, wherein decomposing the matrix W comprises performing a singular value decomposition of W.

2. The machine-implemented method of claim 1, wherein the centered pitch periods are symmetrically zero padded to N samples.

3. The machine-implemented method of claim 1, wherein a feature vector $\bar{u}_i$ is calculated as $$\bar{u}_i=u_i\Sigma$$

where $u_i$ is a row vector associated with a centered pitch period i, and Σ is the singular diagonal matrix.

4. The machine-implemented method of claim 3, wherein the distance between two feature vectors is determined by a metric comprising a closeness measure, C, between two feature vectors, $\bar{u}_k$ and $\bar{u}_l$, wherein C is calculated as $$C(\bar{u}_k, \bar{u}_l) = \cos(u_k\Sigma, u_l\Sigma) = \frac{u_k \sum^{2} u_l^T}{\|u_k\Sigma\|\ \|u_l\Sigma\|}$$

for any $1\leqq k,l\leqq(2(K-1)+1)M$.

5. The machine-implemented method of claim 4, wherein a discontinuity $d(S_1, S_2)$ between two candidate units, $S_1$ and $S_2$, is calculated as $$d(S_1,S_2)=C(u_{\pi-1}u\delta_0)+C(u\delta_0, u_{\sigma 1})-C(u_{\pi-1},u_{\pi 0})-C(u_{\sigma 0}, u_{\sigma 1})$$

where $u_{\pi-1}$ is a feature vector associated with a centered pitch period π−1, $u\delta_0$ is a feature vector associated with a centered pitch period $\delta_0$, $u_{\sigma 1}$ is a feature vector associated with a centered pitch period σ1, $u_{90\ 0}$ is a feature vector associated with a centered pitch period π0, and $u_{\sigma 0}$ is a feature vector associated with a centered pitch period σ0.

6. The machine-implemented method of claim 5, wherein same closeness measure, C, is used for optimizing unit boundaries and for unit selection.

7. A non-volatile computer-readable storage medium having computer-executable instructions that when executed by a computer cause the computer to perform a computer-implemented method comprising:

extracting a portion from segment boundary regions of a plurality of speech segments, each segment boundary region based on a corresponding initial unit boundary;

creating feature vectors that represent the portions in a vector space;

for each of a plurality of potential unit boundaries within each segment boundary region, determining an average discontinuity based on distances between the feature vectors; and for each segment, selecting the potential unit boundary associated with a minimum average discontinuity as a new unit boundary;

wherein the portions include center pitch periods, the centered pitch periods derived from pitch periods of the segments, wherein the feature vectors incorporate phase information of the portions, wherein creating feature vectors comprises:

constructing a matrix W from the portions; and decomposing the matrix W, and wherein the matrix W is a $(2(K-1)+1)M\times N$ matrix represented by $W=U\Sigma V^T$ where K−1 is the number of centered pitch periods near the potential unit boundary extracted from each segment, N is the maximum number of samples among the centered pitch periods, M is the number of segments, U is the $(2(K-1)+1)M\times R$ left singular matrix with row vectors $u_i$ $(1\leqq i\leqq(2(K-1)+1)M)$, Σ is the R×R diagonal matrix of singular values $s_1\geqq s_2\geqq \ldots \geqq s_R>0$, V is the N×R right singular matrix with row vectors $v_j(1\leqq j\leqq N)$, $R<<(2(K-1)+1)M)$, and $^T$ denotes matrix transposition, wherein decomposing the matrix W comprises performing a singular value decomposition of W.

8. The non-volatile computer-readable storage medium of claim 7, wherein the centered pitch periods are symmetrically zero padded to N samples.

9. The non-volatile computer-readable storage medium of claim 7, wherein a feature vector $\bar{u}_1$ is calculated as $$\bar{u}_i=u_i\Sigma$$

where $u_i$ is a row vector associated with a centered pitch period i, and Σ is the singular diagonal matrix.

10. The non-volatile computer-readable storage medium of claim 9, wherein the distance between two featured vectors is determined by a metric comprising a closeness measure, C, between two feature vectors, $\bar{u}_k$ and $\bar{u}_l$, wherein C is calculated as $$C(\bar{u}_k, \bar{u}_l) = \cos(u_k\Sigma, u_l\Sigma) = \frac{u_k \sum^{2} u_l^T}{\|u_k\Sigma\| \, \|u_l\Sigma\|}$$

for any $1 \leqq k,l \leqq (2(K-1)+1)M$.

11. The non-volatile computer-readable storage medium of claim 10, wherein a discontinuity $d(S_1,S_2)$ between two candidate units, $S_1$ and $S_2$, is calculated as $$d(S_1,S_2)=C(u_{\pi-1}, u\delta_0)+C(u\delta_0, u_{\sigma 1})-C(u_{\pi-1}, u_{\pi 0})-C(u_{\sigma 0}, u_{\sigma 1})$$

where $u_{\pi-1}$ is a feature vector associated with a centered pitch period $\pi-1$, $u\delta_0$ is a feature vector associated with a centered pitch period $\delta_0$, $u_{\sigma 1}$ is a feature vector associated with a centered pitch period $\sigma 1$, $u_{\pi 0}$ is a feature vector associated with a centered pitch period $\pi 0$, and $u_{\sigma 0}$ is a feature vector associated with a centered pitch period $\sigma 0$.

12. The non-volatile computer-readable storage medium of claim 11, wherein the same closeness measure, C, is used for optimizing unit boundaries and for unit selection.

13. An apparatus comprising:

means for extracting from segment boundary regions of a plurality of speech segments, each segment boundary region based on a corresponding initial unit boundary;

means for creating feature vectors that represent the portions in a vector space;

for each of a plurality of potential unit boundaries within each segment boundary region, means for determining an average discontinuity based on distances between the feature vectors; and for each segment, means for selecting the potential unit boundary associated with a minimum average discontinuity as a new unit boundary, wherein the portions include centered pitch periods, the centered pitch periods derived from pitch periods of the segments, wherein the feature vectors incorporate phase information of the portions, wherein creating feature vectors comprises:

means for constructing a matrix W from the portions; and means for decomposing the matrix W, and wherein the matrix W is a $(2(K-1)+1)M \times N$ matrix represented by $W=U\Sigma V^T$ where $K-1$ is the number of centered pitch periods near the potential unit boundary extracted from each segment, N is the maximum number of samples among the centered pitch periods, M is the number of segments, U is the $(2(K+1)+1)M \times R$ left singular matrix with row vectors $u_i$ $(1 \leqq i \leqq (2(K-1)+1)M)$, $\Sigma$ is the $R \times R$ diagonal matrix of singular values $s_1 \geqq s_2 \geqq \ldots \geqq s_R > 0$, V is the $N \times R$ right singular matrix with row vectors $v_j (1 \leqq j \leqq N)$, $R << (2(K-1)+1)M)$, and $^T$ denotes matrix transposition, wherein decomposing the matrix W comprises performing a singular value decomposition of W.

14. The apparatus of claim 13, wherein the centered pitch periods are symmetrically zero padded to N samples.

15. The apparatus of claim 13, wherein a feature vector $\bar{u}_i$ is calculated as $$\bar{u}_i = u_i\Sigma$$

wherein $u_i$ is a row vector associated with a centered pitch period i, and $\Sigma$ is the singular diagonal matrix.

16. The apparatus of claim 15, wherein the distance between two feature vectors is determined by a metric comprising a closeness measure, C, between two feature vectors, $\bar{u}_k$ and $\bar{u}_l$, wherein C is calculated as $$C(\bar{u}_k, \bar{u}_l) = \cos(u_k\Sigma, u_l\Sigma) = \frac{u_k \sum^{2} u_l^T}{\|u_k\Sigma\| \, \|u_l\Sigma\|}$$

for any $1 \leqq k,l \leqq (2(K-1)+1)M$.

17. The apparatus of claim 16, wherein a discontinuity $d(S_1,S_2)$ between two candidate units, $S_1$ and $S_2$, is calculated as $$d(S_1,S_2)=C(u_{\pi-1}, u\delta_0)+C(u\delta_0, u_{\sigma 1})-C(u_{\pi-1}, u_{\pi 0})-C(u_{\sigma 0}, u_{\sigma 1})$$

where $u_{\pi-1}$ is a feature vector associated with a centered pitch period $\pi-1$, $u\delta 0$ is a feature vector associated with a centered pitch period $\delta_0$, $u_{\sigma 1}$ is a feature vector associated with a centered pitch period $\sigma_1$, $u_{90\ 0}$ is a feature vector associated with a centered pitch period $\pi_0$, and $u_{\sigma 0}$ is a feature vector associated with a centered pitch period $\sigma_0$.

18. The apparatus of claim 17, wherein the same closeness measure, C, is used for optimizing unit boundaries and for unit selection.

19. A system comprising:

a processing unit coupled to a memory through a bus; and a memory unit storing a process executed by the processing unit to cause the processing unit to:

extract portions from segment boundary regions of a plurality of speech segments, each segment boundary region based on a corresponding initial unit boundary;

create feature vectors that represent the portions in a vector space;

for each of a plurality of potential unit boundaries within each segment boundary region, determine an average discontinuity based on distances between the feature vectors; and for each segment, select the potential unit boundary associated with a minimum average discontinuity as a new unit boundary, wherein the portions include centered pitch periods, the centered pitch periods derived from pitch periods of the segments, wherein the feature vectors incorporate phase information of the portions, wherein the process further causes the processing unit, when creating feature vectors, to:

construct a matrix W from the portions; and decompose the matrix W, and wherein the matrix W is a $(2(K-1)+1)M \times N$ matrix represented by $W=U\Sigma V^T$ where $K-1$ is the number of centered pitch periods near the potential unit boundary extracted from each segment, N is the maximum number of samples among the centered pitch periods, M is the number of segments, U is the $(2(K-1)+1)M\times R$ left singular matrix with row vectors $u_i(1\leqq i\leqq(2(K-1)+1)M)$, $\Sigma$ is the $R\times R$ diagonal matrix of singular values $s_1\geqq s_2\geqq \ldots \geqq s_R>0$, V is the $N\times R$ right singular matrix with row vectors $v_j(1\leqq j\leqq N)$, $R<<(2(K-1)+1)M$, and $^T$ denotes matrix transposition, wherein decomposing the matrix W comprises performing a singular value decomposition of W.

20. The system of claim 19, wherein the centered pitch periods are symmetrically zero padded to N samples.

21. The system of claim 19, wherein a feature vector $\bar{u}_i$ is calculated as $$\bar{u}_i=u_i\Sigma$$

where $u_i$ is a row vector associated with a centered pitch period i, and $\Sigma$ is the singular diagonal matrix.

22. The system of claim 21, wherein the distance between two feature vectors is determined by a metric comprising a closeness measure, C, between two feature vectors, $\bar{u}_k$ and $\bar{u}_l$, wherein C is calculated as $$C(\bar{u}_k, \bar{u}_l) = \cos(u_k\Sigma, u_l\Sigma) = \frac{u_k \sum^{2} u_l^T}{\|u_k\Sigma\| \, \|u_l\Sigma\|}$$

for any $1\leqq k,l\leqq(2(K-1)+1)M$.

23. The system of claim 22, wherein a discontinuity $d(S_1, S_2)$ between two candidate units, $S_1$ and $S_2$, is calculated as $$d(S_1,S_2)=C(u_{\pi-1}, u\delta_0)+C(u\delta_0, u_{\sigma 1})-C(u_{\pi-1}, u_{\pi 0})-C(u_{\sigma 0}, u_{\sigma 1})$$

where $u_{\pi-1}$ is a feature vector associated with a centered pitch period $\pi-1$, $u\delta_0$ is a feature vector associated with a centered pitch period $\delta_0$, $u_{\sigma 1}$ is a feature vector associated with a centered pitch period $\sigma_1$, $u_{\pi 0}$ is a feature vector associated with a centered pitch period $\pi_0$, and $u_{\sigma 0}$ is a feature vector associated with a centered pitch period $\sigma_0$.

24. The system of claim 23, wherein the same closeness measure, C, is used for optimizing unit boundaries and for unit selection.

* * * * *